US008181806B2

(12) United States Patent
Hidalgo Vargas

(10) Patent No.: US 8,181,806 B2
(45) Date of Patent: May 22, 2012

(54) COLLAPSIBLE CONTAINER

(76) Inventor: Edgar Hidalgo Vargas, San Jose (CR)

( * ) Notice: Subject to any disclaimer, the term of this patent is extended or adjusted under 35 U.S.C. 154(b) by 688 days.

(21) Appl. No.: 12/356,035

(22) Filed: Jan. 19, 2009

(65) Prior Publication Data

US 2009/0134057 A1 May 28, 2009

Related U.S. Application Data

(63) Continuation-in-part of application No. 11/113,209, filed on Apr. 25, 2005, now Pat. No. 7,478,734.

(51) Int. Cl.
*B65D 6/00* (2006.01)

(52) U.S. Cl. ..... 220/4.34; 220/4.08; 220/4.28

(58) Field of Classification Search ..... 220/4.34, 220/4.08, 4.09, 4.16, 4.22, 4.23, 4.28, 6, 220/7, 646, 4.32; 206/386, 600
See application file for complete search history.

(56) References Cited

U.S. PATENT DOCUMENTS 1,883,553 A * 10/1932 Chain ..... 220/4.34
3,246,828 A * 4/1966 Branscum et al. ..... 220/4.34
3,405,835 A * 10/1968 Eby ..... 220/4.34
4,300,695 A * 11/1981 Hsu ..... 220/6
4,789,075 A * 12/1988 Sun ..... 220/4.34
5,269,414 A * 12/1993 D'Hollander ..... 206/600
5,515,987 A * 5/1996 Jacques et al. ..... 220/6
5,938,059 A * 8/1999 Luburic ..... 220/6
6,006,918 A * 12/1999 Hart ..... 206/600
6,415,938 B1 * 7/2002 Karpisek ..... 220/1.5
6,601,723 B1 * 8/2003 Ziglar ..... 220/4.34
7,156,249 B2 * 1/2007 Heinrichs ..... 220/4.28
2006/0237455 A1 * 10/2006 Vargas ..... 220/4.34

* cited by examiner

*Primary Examiner* — Bryon Gehman
*Assistant Examiner* — Shawn Braden
(74) *Attorney, Agent, or Firm* — Sanchelima & Associates, P.A.

(57) ABSTRACT

A collapsible container that in the assembled configuration provides for a predetermined central space protected by six walls that are perpendicularly mounted with respect to each abutting wall and in the e collapsed configuration occupies minimum space. A bottom wall is provided with a predetermined umber of hinge knuckles with a central through opening through which pins are passed. Parapets of different heights are provided to raise the knuckles to predetermined heights that will clear the stacked up thickness of the folded walls. The height of the front, rear and the two side lateral walls is determined by the width of the bottom wall which in turn will also determine the width and height of the front and rear walls. A handle is removably mounted to the top wall, protruding toward the exterior.

5 Claims, 9 Drawing Sheets

COLLAPSIBLE CONTAINER

OTHER RELATED APPLICATIONS

The present application is a continuation-in-part of the allowed U.S. patent application Ser. No. 11/113,209, filed on Apr. 25, 2005, now U.S. Pat. No. 7,478,734 which is hereby incorporated by reference.

BACKGROUND OF THE INVENTION

1. Field of the Invention

The present invention relates to a collapsible container that is volumetrically efficient for storage and transportation.

2. Description of the Related Art

Several designs for collapsible containers have been designed in the past. None of them, however, includes collapsible parts that can be readily reassembled, as claimed in the present application.

Applicant believes that the closest reference corresponds to U.S. application Ser. No. 11/113,209 filed by the applicant, now allowed, for a collapsible container. However, it differs from the present invention because the walls collapse inwardly over each other, resembling a flattened suitcase with the consequent volumetric efficiency for storage and transportation. With less parts, the present invention can be assembled and disassembled faster than the prior invention. Only one pin needs to be removed in the present invention to cause it to collapse.

Other patents and publications describing the closest subject matter provide for a number of more or less complicated features that fail to solve the problem in an efficient and economical way. None of these patents suggest the novel features of the present invention.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
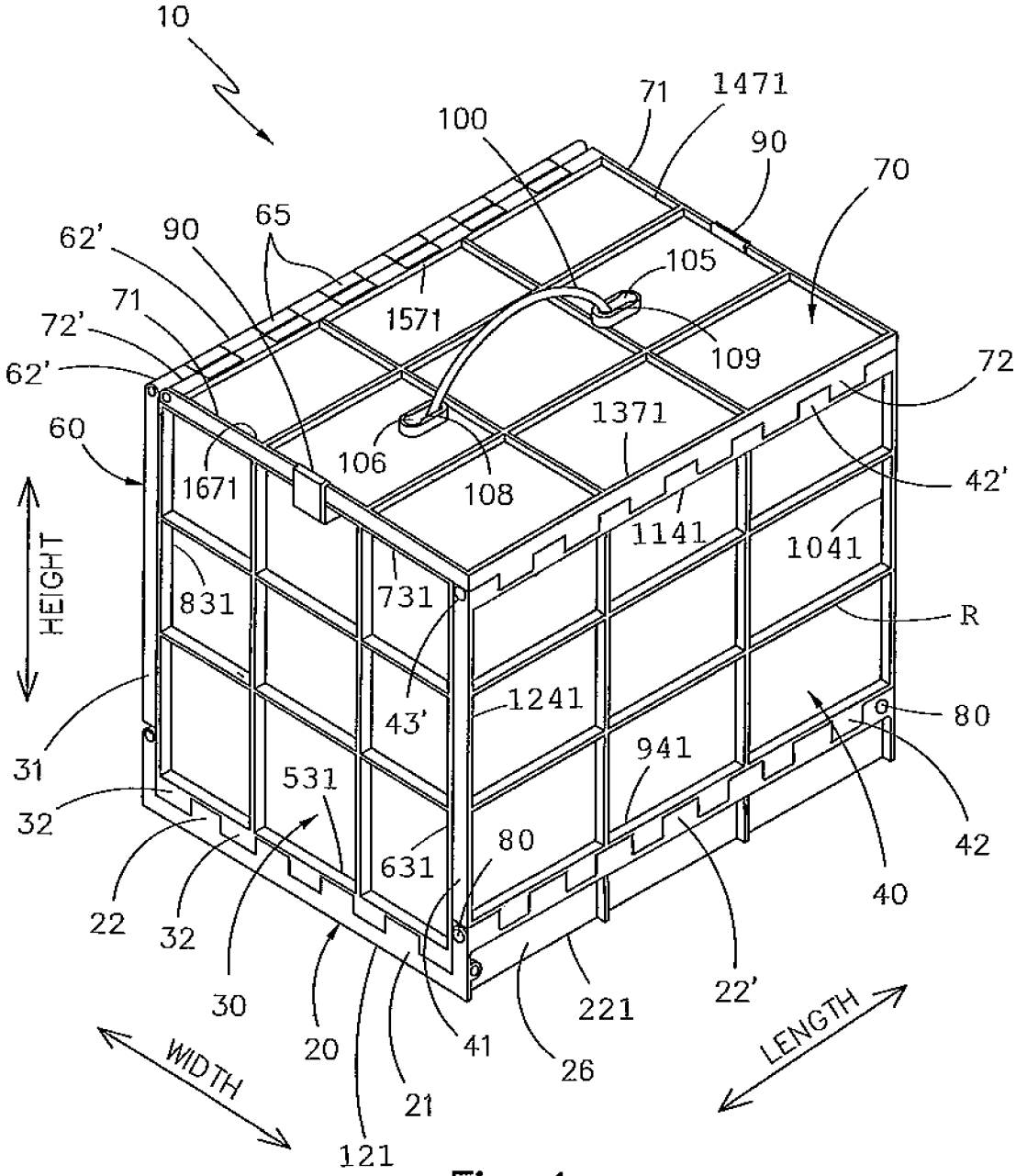
FIG. 1 is an isometric view of a collapsible container invention subject of the present application.
Figure 2:
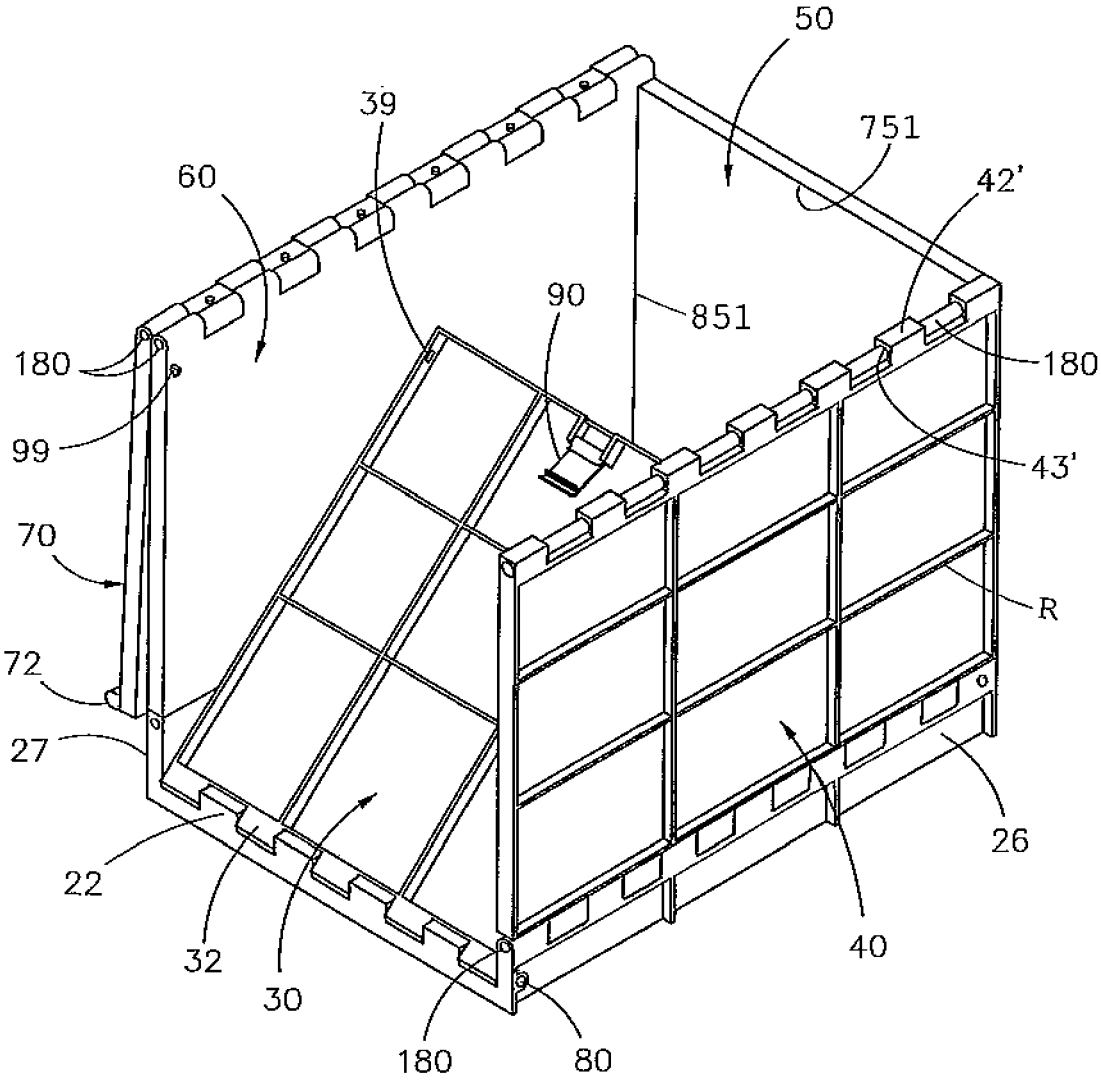
FIG. 2 is an isometric view of the container shown in the previous figure partially showing the interior of the container with the top panel folded out and down and the lateral front panel being folded in and down.
Figure 3:
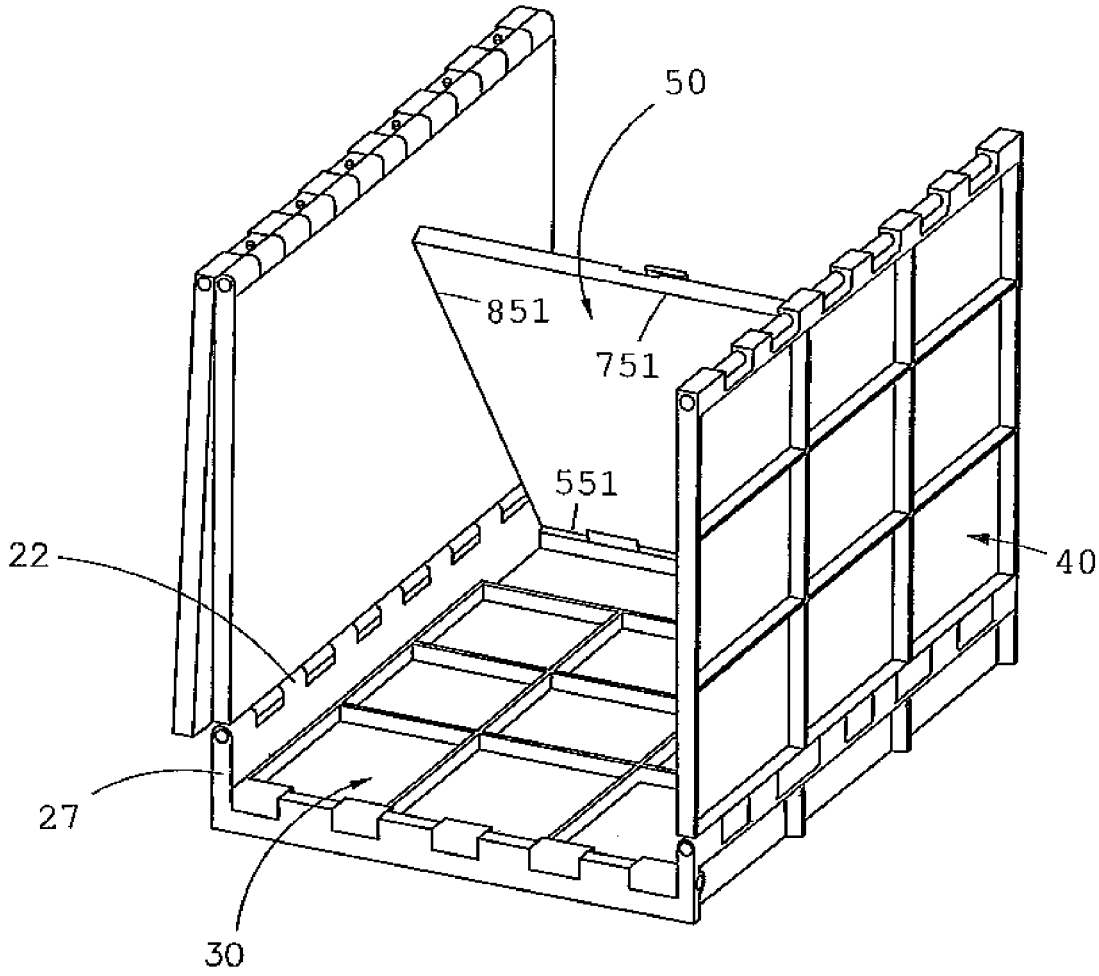
FIG. 3 shows an isometric view of the container shown in the previous figures with the rear panel being folded inwardly.
Figure 4:
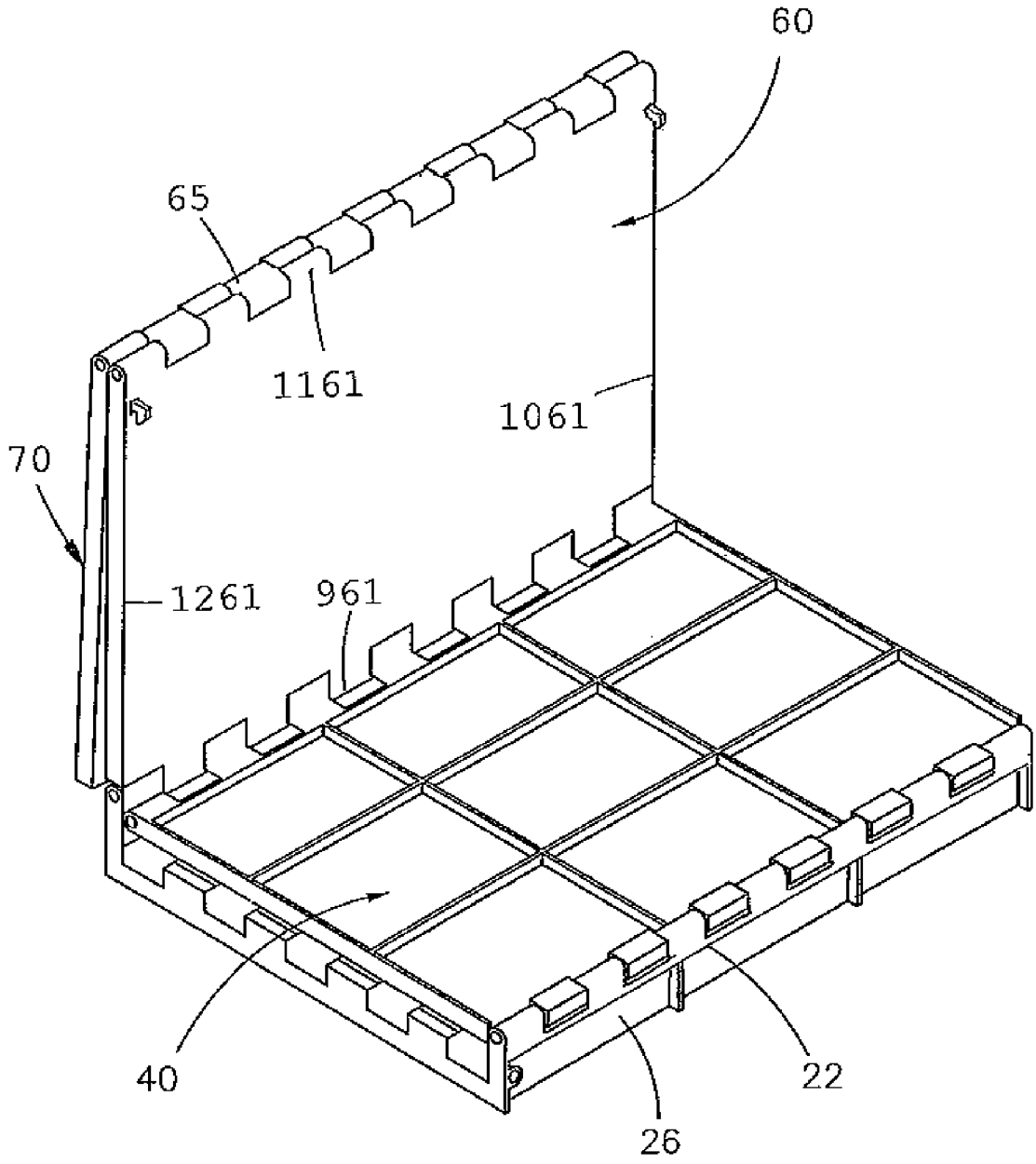
FIG. 4 is an isometric representation of the container shown in the previous figures with the right lateral side folded down.
Figure 5:
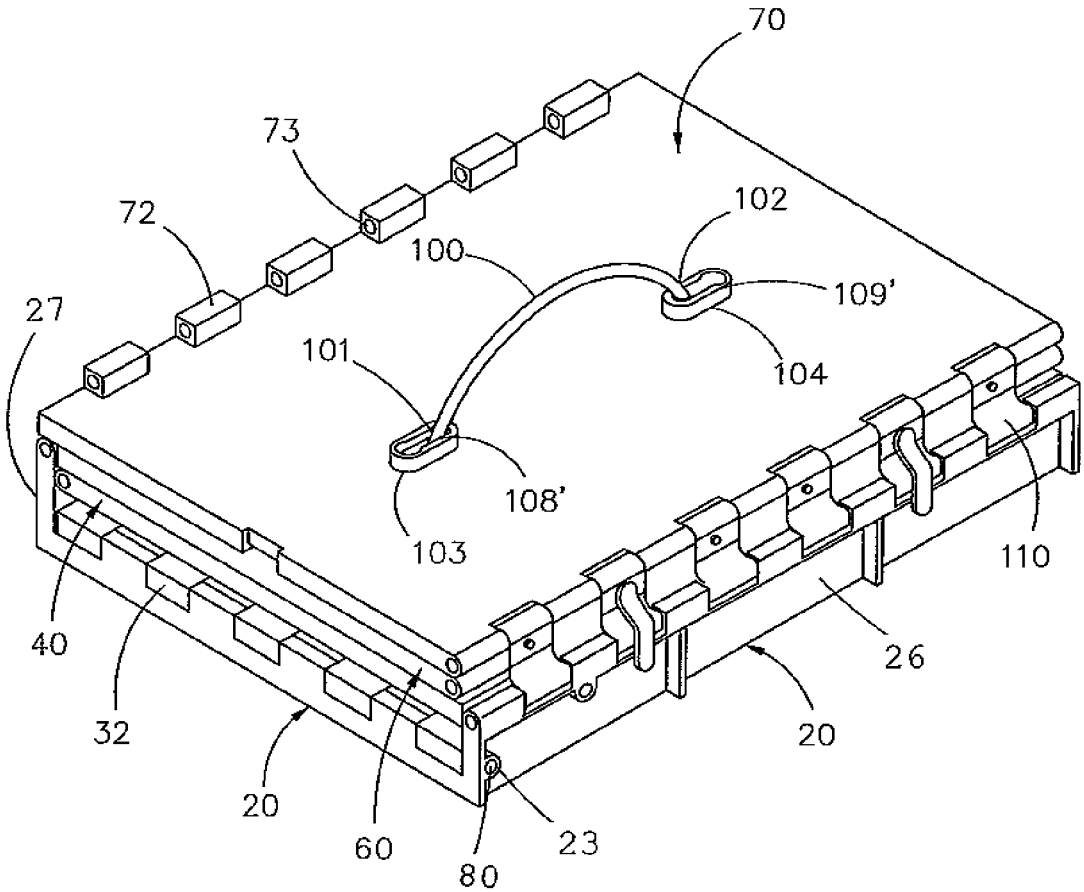
FIG. 5 is an isometric view of the container shown in the previous figure in collapsed position with a removable handle.
Figure 8:
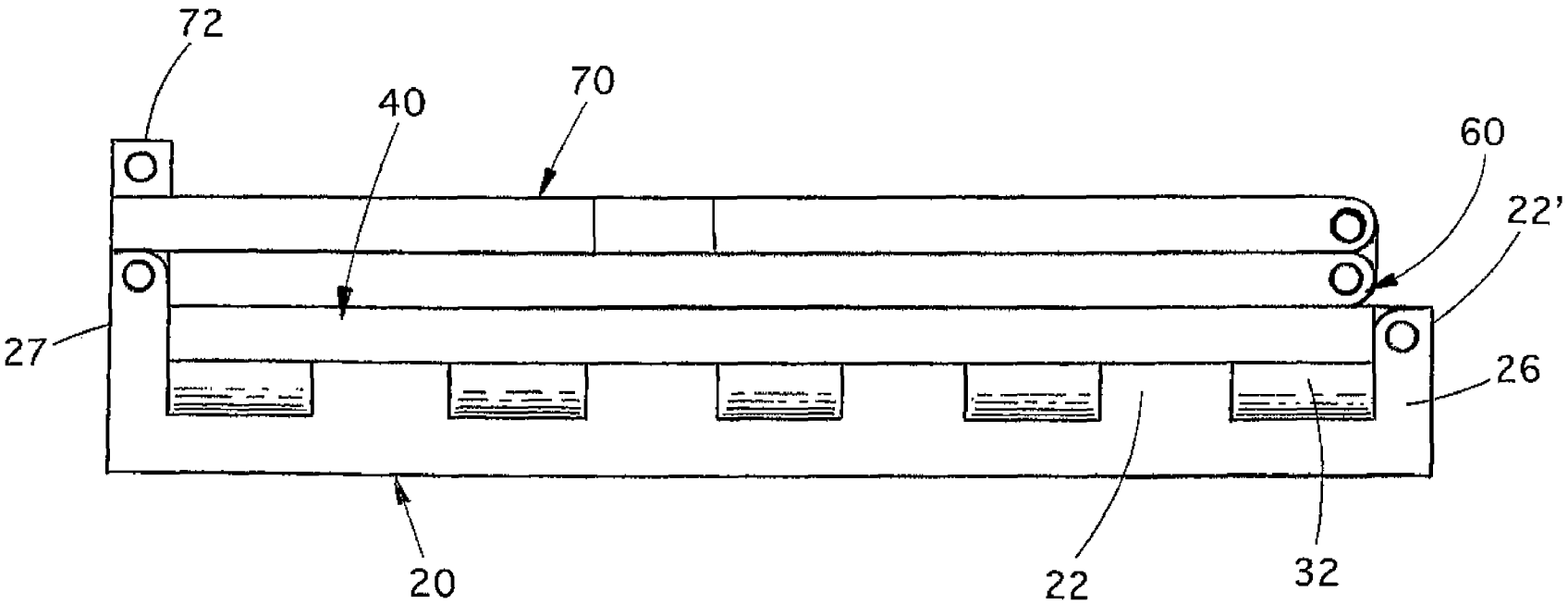
FIG. 8 is a front elevational view of the container shown in the previous figures in the collapsed position.

Referring now to the drawings, where the present invention is generally referred to with numeral 10, it can be observed that it basically includes bottom wall 20, lateral panels or walls 30 (front), 40 (right), 50 (rear), and 60 (left), and top wall 70 perpendicularly and hingedly mounted to each other in the assembled configuration, as best seen in FIG. 1. Each of these walls or panels has an external surface and an internal surface. Collapsible container 10 can be disassembled, as shown in FIGS. 2 through 4, arriving at the collapsed configuration shown in FIG. 5. Therefore, in the assembled configuration a space is defined within bottom wall 20, front and rear walls 30; 50, right and left side lateral walls 40; 60, and top wall 70 when these walls are perpendicular to contiguous walls. And, in the collapsed configuration, these walls 20; 30; 40; 50; 60; and 70 are stacked over each other, as seen in FIGS. 5 and 8. The walls have the same thickness T in this embodiment to simplify the explanation of how the present invention works.

The designs of these walls may vary to accommodate conventional features such as reinforcement ribs R or other molding and/or production considerations.

Walls 20; 30; 40; 50; 60; and 70 are rectangular with peripheral edges 21; 31; 41; 51; 61; and 71, respectively, with four longitudinal sides each. In this application, the longitudinal dimensions of the container 10 and its walls will be referred to as width, length, and height, as shown in FIG. 1. These dimensions will include the dimensions of the walls' respective integrally built hinge members, except for hinge members 22' and 22''' that extend from parapets 26 and 27, respectively. The width of similar front and rear walls 30 and 50 correspond to the width of bottom wall 20 at its front and rear. The height of front and rear walls 30 and 50 (and lateral walls 40 and 60) will not exceed their width, which is dictated by the width of bottom wall 20. Therefore, walls 30 and 50 will have a square shape at their maximum height. The overall height of lateral walls 40 and 60 corresponds to the height of walls 30 and 50.

In the embodiment shown in FIGS. 1 through 8, the actual height of wall 40 is the height of walls 30 and 50 less one thickness T corresponding to the height of parapet 26. In the embodiment represented in the figures, parapet 26 is integrally mounted on top of wall 20 and hinge members 22' extend upwardly. The actual height of wall 60 is the height of walls 30 and 50 less two thicknesses T accounting for the height of parapet 27. Other embodiments can be designed with different lengths for walls 40 and 60. If the length of walls 40 and 60 is larger than twice the height of walls 30 and 50, then the height of parapet 27 is only one thickness T and the height of walls 40 and 60, since, in that case, walls 30 and 50 will be coplanarly folded and not on top of each other. In the embodiment shown in FIGS. 1 through 6, the height of walls 30 and 50 is larger than one half of the length of walls 20; 40; and 60. Therefore, when folded, walls 30 and 50 will be stacked over each other.

To facilitate the identification of the different elements in this application, it will be understood that lateral wall 40 may be referred to as the right lateral wall 40, if needed and the longitudinal sides of peripheral edges 21; 31; 41; 51; 61; and 71 may also be referred to by qualifying them with the words "left", "right", "upper", "lower", "front", or "rear", as needed. To facilitate the interpretation of the claims, where first, second, third, fourth, fifth, and sixth walls are used, the reference numerals have been selected to coincide with the claims language. Therefore, peripheral edge 21 includes longitudinal sides 121; 221; 321; and 421. These correspond to the first, second, third, and fourth sides in the claims. Peripheral edges 31 and 51 include, respectively, longitudinal sides 531; 631; 731; 831; 551; 651; 751; and 851, corresponding to the fifth, sixth, seventh, and eighth longitudinal sides of front and rear walls 30 and 50 in the claims. Similarly, peripheral edges 41 and 61 include, respectively, longitudinal sides 941; 1041; 1141; 1241; 961; 1061; 1161; and 1261 corresponding to the ninth, tenth, eleventh, and twelfth longitudinal sides of right and left longitudinal walls 40 and 60, respectively. Lastly, peripheral edge 71 of top wall 70 includes longitudinal sides 1371; 1471; 1571; and 1671 corresponding to the thirteenth, fourteenth, fifteenth, and sixteenth longitudinal sides in the claims. Also, in this embodiment panels or walls 30; 40; 50; and 60 will have the same predetermined thickness T.

As best seen in the embodiments shown in FIG. 1, bottom wall 20 includes four sets of hinge members 22 coaxially mounted adjacent to the front side 121 of edge 21 of bottom wall 20. Hinge pins 80 are receivable within hinge members 22 and 22" to hingedly mount lateral walls 30 and 50 to the front and rear sides 121 and 321 of wall 20 with cooperating hinge members 32 and 52. Hinge pins 180 are longer than hinge pins 80 in this embodiment because walls 20; 40; and 60 are longer than the width of walls 20; 30; and 50. Hinge pins 180 are passed through members 22' and 22'" and are coaxially and hingedly mounted adjacent to the lower sides 941 and 961 of walls 40 and 60, respectively. Walls 40 and 60 to wall 20 with cooperating hinge members 42 and 62. The length of walls 40 and 60 have to be at least the width of wall 20. Hinge pins 80 and 180 are thus positioned at a parallel and spaced apart relationship with respect to the plane of bottom wall 20.

Figure 6:
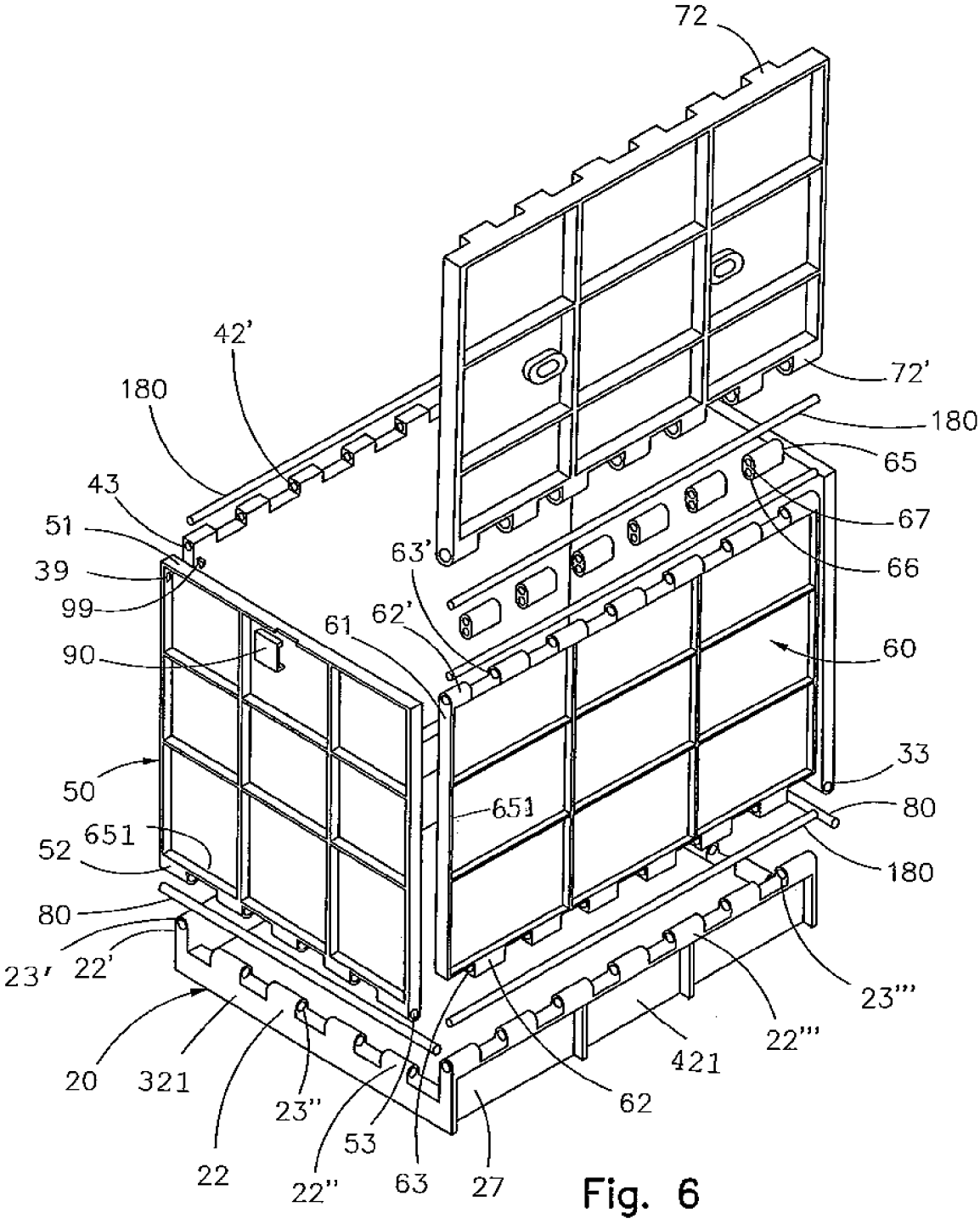
FIG. 6 is an exploded isometric view of the container shown in the previous figures, as seen from the rear.

Right side 221 of peripheral edge 21 of bottom wall 20 is characterized by having a longitudinal parapet 26 with a height slightly larger than two thicknesses T accounting for the thickness of walls 30 (and 50) in the embodiment shown in FIGS. 1 through 8. Hinge members 22' are coaxially mounted over parapet 26 leaving a space in between to receive hinge members 42. As it can be seen from FIGS. 2 and 3, front and rear walls 30 and 50, when folded, will lay above bottom wall 20 since their height is larger than one half of the length of bottom walls 20; 40; and 60. Walls 30 and 50 can be brought in abutting contact with bottom wall 20, if the height of walls 30 and 50 is less than half the length of walls 20; 40; and 60. Walls 30 and 50 are then folded on top of bottom wall 20. Therefore, depending on the height of walls 30 and 50 and the length of walls 40 and 60, the collapsed configuration of the container will have five or six wall thicknesses T when collapsed. Wall 30 includes hinge members 32, as best seen in FIGS. 1 and 2, that are mounted to the lower side 531 of edge 31 with their respective through holes 33 coaxially aligned with through holes 23 of hinge members 22. Similarly, wall 50 includes hinge members 52 with their respective through holes 53, as best seen in FIG. 6, coaxially aligned with through holes 23" and hinge members 22". Pins 80 are passed through holes 23 and 53.

To fold right side wall 40, as shown in FIG. 4, hinge member 22' needs to be mounted on parapet 26 along an axis that is kept at a parallel and spaced apart relationship with respect to the plane of the internal surface of bottom panel 20. Parapet 26 is one thickness T in height. Hinge members 42 have cooperative dimensions to be received between hinge members 22' with their respective through holes 23' and 43 coaxially aligned. The thickness of these walls can be different; if needed for a particular purpose. In that case, the height of parapet 26 will have to be adjusted accordingly but to simplify the explanation of this invention in this application; the thickness T of all walls here is the same for this embodiment.

On the left side (in FIG. 1) of edge 21 of bottom wall 20, as best seen in FIG. 6 (FIG. 6 shows the rear of the container), parapet 27 is shown. Parapet 27 has a height of two thicknesses T from the internal surface of bottom wall 20 with hinge members 22'" are mounted thereon and with coaxially aligned through openings 23'" for receiving pin 180 therethrough. The two thicknesses T are needed because walls 30 and 50 are folded over each other, partially overlapping in this embodiment. If their height is larger than one half of the length of walls 40 and 60, then three thicknesses T would be needed for the height of parapet 27 to account for the thickness of walls 30; 40; and 50.

Lateral wall 60 is pivotally mounted to parapet 27 of wall 20 with pin 180. As best seen in FIG. 6, the lower side 961 of peripheral edge 61 of wall 60 includes hinge member 62 with through holes 63 that are brought in coaxial alignment with through holes 23'" to receive pin 180 therethrough. The upper side 1161 of peripheral edge 61 includes spaced apart hinge members 62' with through holes 63' for receiving removable pin 180 therethrough. Panel 60 is folded on top of wall 40, which in turn is folded over walls 30 and 50, which in turn are folded over bottom panel 20, in the embodiment shown in FIGS. 1 through 8.

Figure 7:
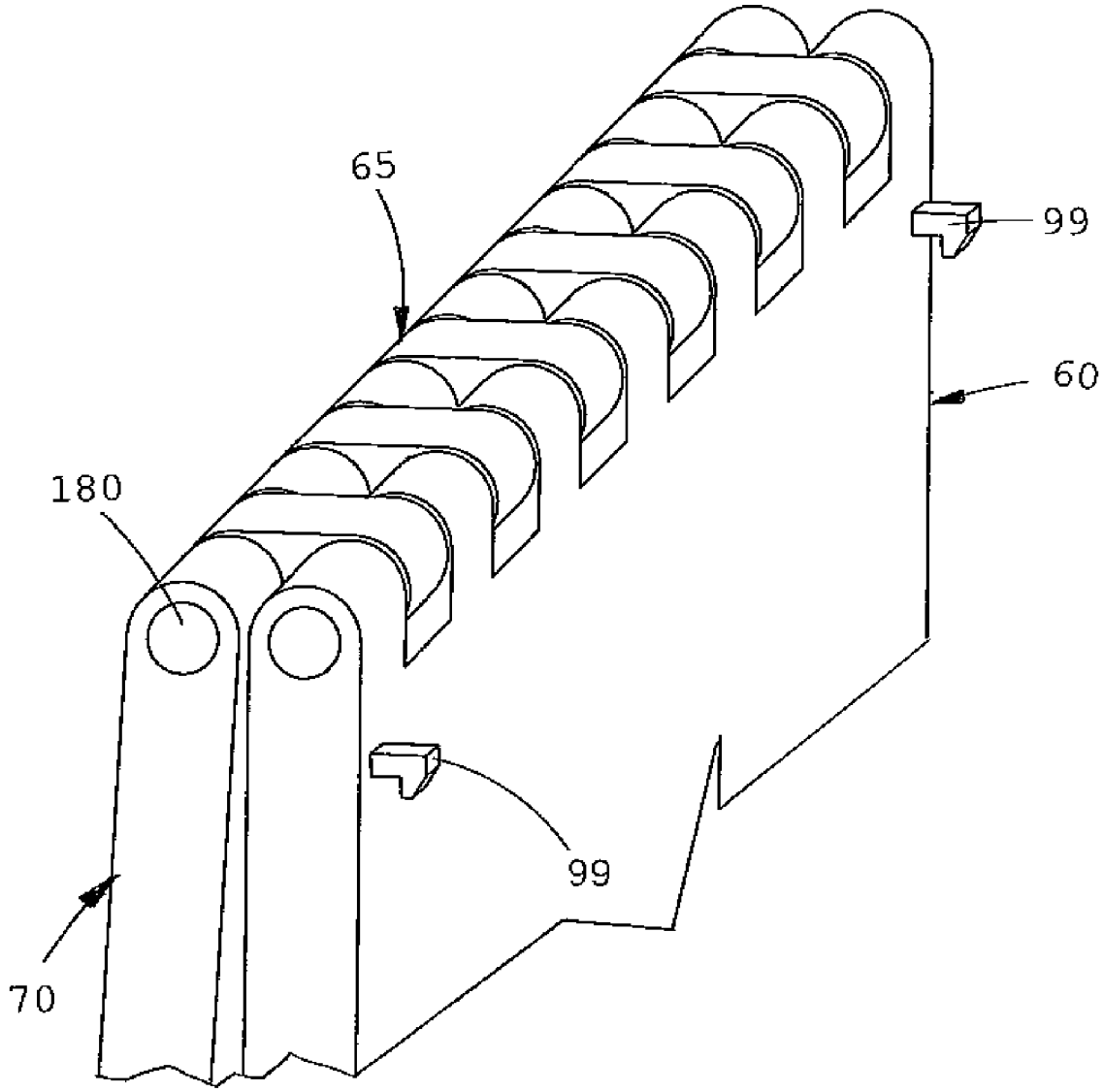
FIG. 7 is an isometric view of the hinged longitudinal ends of the top and side panels seen from the rear.
Figure 9:
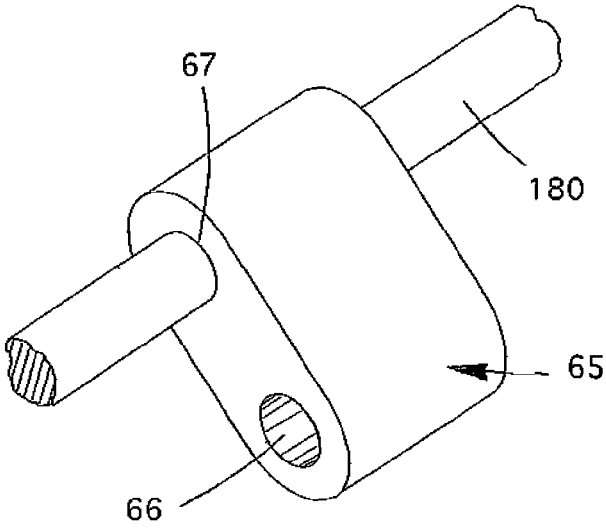
FIG. 9 is an enlarged isometric view of tubular connector member 65 and a portion of pin 180 inserted through hole 67.

Additionally, top wall panel 70 is hingedly mounted to the upper side 1161 of edge 61 of lateral wall 60, and it is folded out and brought against the outside surface of wall 60, as best seen in FIG. 1. Tubular connector members 65 have through openings 66 and 67 that run parallel to each other longitudinally along member 65, as best seen in FIGS. 7 and 9. Members 65 have cooperative dimensions to fit between hinge members 72' and 62'. Wall 70, as seen in FIGS. 1 and 6, includes lock members 72 along the right (using FIG. 1 as reference) side 1371 of peripheral edge 71. Lock members 72 are mounted perpendicular to the plane of wall 70. Members 72 have cooperative dimensions to fit between lock members 42' with their through holes 73 coaxially aligned with through holes 43'. Locking members 42' and 72, along with pin 180, function to lock wall 70 in place even though they are similar to the other hinge members. In FIG. 2 it can be seen that, when disassembling container 10, pin 180 can be left inside through holes 43' rather than storing it separately. In the collapsed disposition, as shown in FIG. 5, wall 70 has been flipped so that members 72 do not interfere with the adjacent wall. Wall 70 is flipped and placed above wall 60 for the collapsed configuration. S-shaped clip 110, or equivalent, is used to keep wall 70 in place. The resulting collapsed configuration has an overall height of six T (it could also be five thicknesses T if the height of walls 30 and 50 were smaller than the length of walls 20; 40; and 60), which can be readily stacked up in a volumetric fashion.

Figure 10:
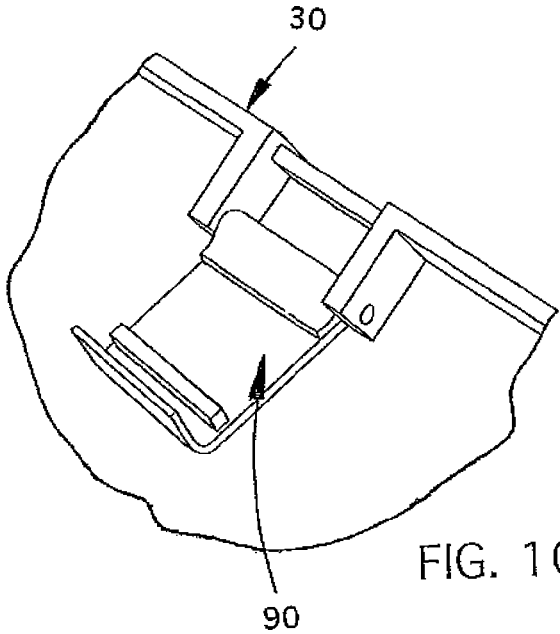
FIG. 10 is a partial representation of front wall 30 with clip 90 mounted thereon and with cooperative dimensions to engage top wall 70 (not shown).
Figure 11:
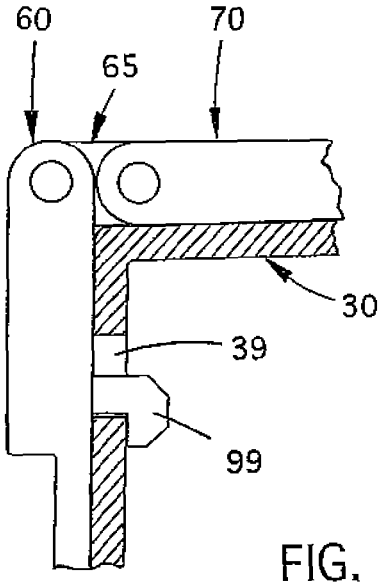
FIG. 11 is a partial cross-section of a corner of container 10 showing headed locking pin 99 protruding through cooperating through opening 39 and engaging the interior surface of wall 30.

Latch or clip members 90 are mounted adjacent to the upper edge 31 and the front of edge 71 as well as upper edge 51 and the rear of edge 71. A representation of clip 90 is shown in FIG. 10. This will keep container 10 in the assembled and closed disposition in the event that lock members 72 and 42' are not used or in addition thereto. Other equivalent mechanisms can be utilized to secure walls 30 and 40 in place. Another mechanism is shown in FIG. 11 wherein headed locking pin 99 is mounted to inner surface of wall 60 and a cooperating through opening 39. Opening 39 cammingly allows pin 99 therethrough to engage wall 30.

Figure 5A:
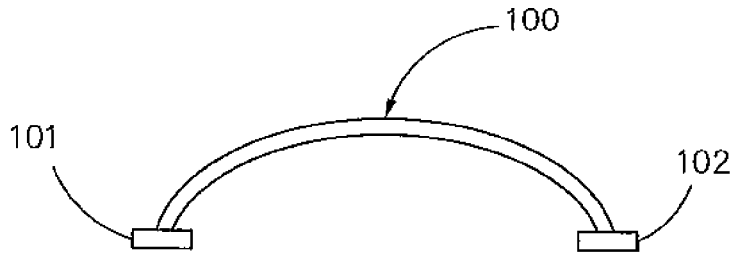
FIG. 5A is an enlarged elevational view of the handle shown in the previous figure.

Handle member 100, in one of the embodiments, is an arched elongated resilient piece, as best seen in FIG. 5A. Member 100 has two headed ends 101 and 102 that are passed through the wider ends 105 and 106, respectively, upon slight stretching, and then allowed to recover bringing the ends 105 and 106 within the narrower portion of slots 108 and 109 in receiving protuberances 103 and 104, as seen in FIGS. 1 and 5. In FIG. 5, slots 108' and 109' are mounted on the interior surface of wall 70 since the latter is flipped over for the collapsed disposition.

As best seen in FIG. 11, wall 60 includes headed locking pin 99 that is cammingly introduced through cooperating through opening 39. The headed termination of pin 99 coacts with the internal surface of wall 30 to keep the latter perpendicularly disposed with respect to the abutting walls.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A collapsible container, comprising:

A) a rectangular bottom wall with internal and external surfaces and having predetermined first length and first width dimensions with a first peripheral edge that in turn includes first, second, third, and fourth contiguous longitudinal sides, said second side including a perpendicularly and longitudinally extending first parapet of a first predetermined height and said fourth side including a perpendicularly and longitudinally extending second parapet having a second predetermined height;

B) rectangular front and rear lateral walls with internal and external surfaces, each having a third predetermined height dimension that is substantially the same, or smaller, as said first length dimension and the width of said front and rear walls having substantially the same dimension of said first width dimension, and said front and rear lateral walls including second and third peripheral edges, respectively, that in turn each includes fifth, sixth, seventh, and eighth longitudinal sides wherein said fifth sides of said front and rear walls are hingedly mounted to said first and third sides, respectively;

C) rectangular first and second side lateral walls with internal and external surfaces, each of said first and second side lateral walls having a length that is the same, or substantially the same, as said first length dimension, and said first and second side lateral walls including fourth and fifth peripheral edges that in turn each includes ninth, tenth, eleventh, and twelfth longitudinal sides, said ninth longitudinal sides of said first and second side lateral walls being hingedly mounted to said first and second parapets so that the height of said first side lateral wall and said first parapet is substantially the same as said predetermined third height dimension and the height of said second side lateral wall added to said second parapet is substantially the same as said predetermined third height dimension;

D) a top wall having the same, or substantially the same, dimensions as said bottom wall, with internal and external surfaces, and further including a sixth peripheral edge that in turn includes thirteenth, fourteenth, fifteenth, and sixteenth longitudinal sides, wherein said fifteenth side includes means for hingedly mounting said fifteenth side to one of said eleventh sides, wherein said means for hingedly mounting said fifteenth side to one of said eleventh sides includes a first plurality of first hinge members each having a coaxially disposed first through hole, said first plurality of first hinge members being mounted to said fifteenth longitudinal side and extending coplanarly therefrom and being spaced apart from each other a predetermined distance, a first plurality of second hinge members each having a coaxially disposed second through hole, said first plurality of second hinge members being mounted to one of said eleventh sides, extending coplanarly therefrom and at a spaces apart relationship with respect to each other, said first plurality of first and second hinge members being cooperatively positioned to coincide with each other, and further including a second plurality of connectors with first and second through openings extending parallel to each other and brought in coaxial alignment with said first and second through holes and further including first and second elongated hinge pins receivable within said first and second though holes and first and second through openings, respectively, so that said top wall can be brought from a perpendicular disposition with respect to said first and second lateral walls to an abutting and parallel disposition to one of said first or second lateral walls to which said top wall is hingedly mounted; and E) means for releasably locking said thirteenth side to the other of said eleventh side so that in a configuration of said collapsible container a space is defined within said top, bottom, front, rear, first, and second lateral walls when perpendicular to each abutting wall and in another configuration said walls are stacked over each other within and in parallel with said bottom wall, wherein said means for releasably holding said thirteenth side to said other of said eleventh sides includes a first plurality of coaxially disposed first lock members, each having a first central through opening, extending from said thirteenth side and a second plurality of cooperating second lock members extending from said other eleventh side, each having a second central through opening brought in cooperative coaxial with said first central through opening, and a third elongated pin having cooperative dimensions to be received within said first and second central through openings.

2. The container set forth in claim 1 wherein said third predetermined height dimension of said front and rear lateral walls is less that one half the length of said first and second lateral walls and said first and second predetermined heights of said first and second parapets is the same.

3. The container set forth in claim 2 wherein at least one of said first and second side lateral walls includes a headed locking pin that extends perpendicularly inwardly from the internal surface of tenth and twelfth sides and cooperating through openings on said sixth and seventh sides of said at least one of said front and rear lateral walls for releasably engaging said headed locking pin thereby keeping said first and second side lateral walls perpendicularly disposed with respect to said front and rear lateral walls.

4. The container set forth in claim 3 further including at least one clip member for releasably engaging at least one of said front and rear lateral walls to said top wall.

5. The container set forth in claim 4 further including a handle member removably mounted to the external surface of said top wall.

* * * * *